United States Patent [19]

Magid et al.

[11] 4,182,514

[45] Jan. 8, 1980

[54] PRE-PROGRAMMABLE OBSTACLE POSITIONING ELECTRONIC GAME

[76] Inventors: Donni Magid, 923 Tyson Ave., Roslyn, Pa. 19001; Zelig Z. Magid, 460 Parlin St., Philadelphia, Pa. 19116

[21] Appl. No.: 801,888

[22] Filed: May 31, 1977

[51] Int. Cl.[2] ..... A63F 9/14

[52] U.S. Cl. ..... 273/237

[58] Field of Search ..... 273/1 E, 85 G, 130 AB, 273/131 A, 134 A, 135 A, 136 A, 237; 235/92 GA; 340/323 R

[56] References Cited

U.S. PATENT DOCUMENTS

| | | | |
|---|---|---|---|
| 3,081,088 | 3/1963 | Kast | 273/130 AB |
| 3,327,405 | 6/1967 | Ingeneri | 35/9 C X |
| 3,376,041 | 4/1968 | Anderson | 273/1 E X |
| 3,404,889 | 10/1968 | Warner | 273/130 AB |
| 3,516,671 | 6/1970 | Estrin | 273/130 AB |
| 3,640,536 | 2/1972 | Godmer | 273/130 AB |
| 3,690,665 | 9/1972 | Becker | 273/237 |
| 3,779,553 | 12/1973 | Secter | 273/130 AB |
| 3,844,564 | 10/1974 | Barish | 273/136 A X |
| 3,888,491 | 6/1975 | Bernard et al. | 273/136 A |
| 4,017,072 | 4/1977 | Kurtz | 273/130 AB X |

*Primary Examiner*—Vance Y. Hum

*Attorney, Agent, or Firm*—Seidel, Gonda, Goldhammer & Panitch

[57] ABSTRACT

An electronic game comprising a board provided with plural discrete positions including a predetermined target position. A plurality of light sources is associated with the board, each light source being associated with one of the board positions. A light source indicates the position of the player on the board. Plural manually operable direction switches advance the position of the player via a direction logic gating circuit in combination with plural up/down counters and a binary to decimal decoder. A programmable board provided with plural obstacle positions correlated to the positions of the playing board prevents the advance of the player to preselected board positions via an obstacle check circuit, an initiate obstacle encounter gate, and a three bit counter.

16 Claims, 12 Drawing Figures

150
152
154
156
158
160
162
164
166
168
170
172
174
176
178
182
184
186
188
190
XE
A
YE
B
C
D
UP
DN
VX
VY
HX
HY
VX0
VX1
VX2
VY0
VY1
VY2
HX0
HX1
HX2
HY0
HY1
HY2
CLOCK RESET/PRESET

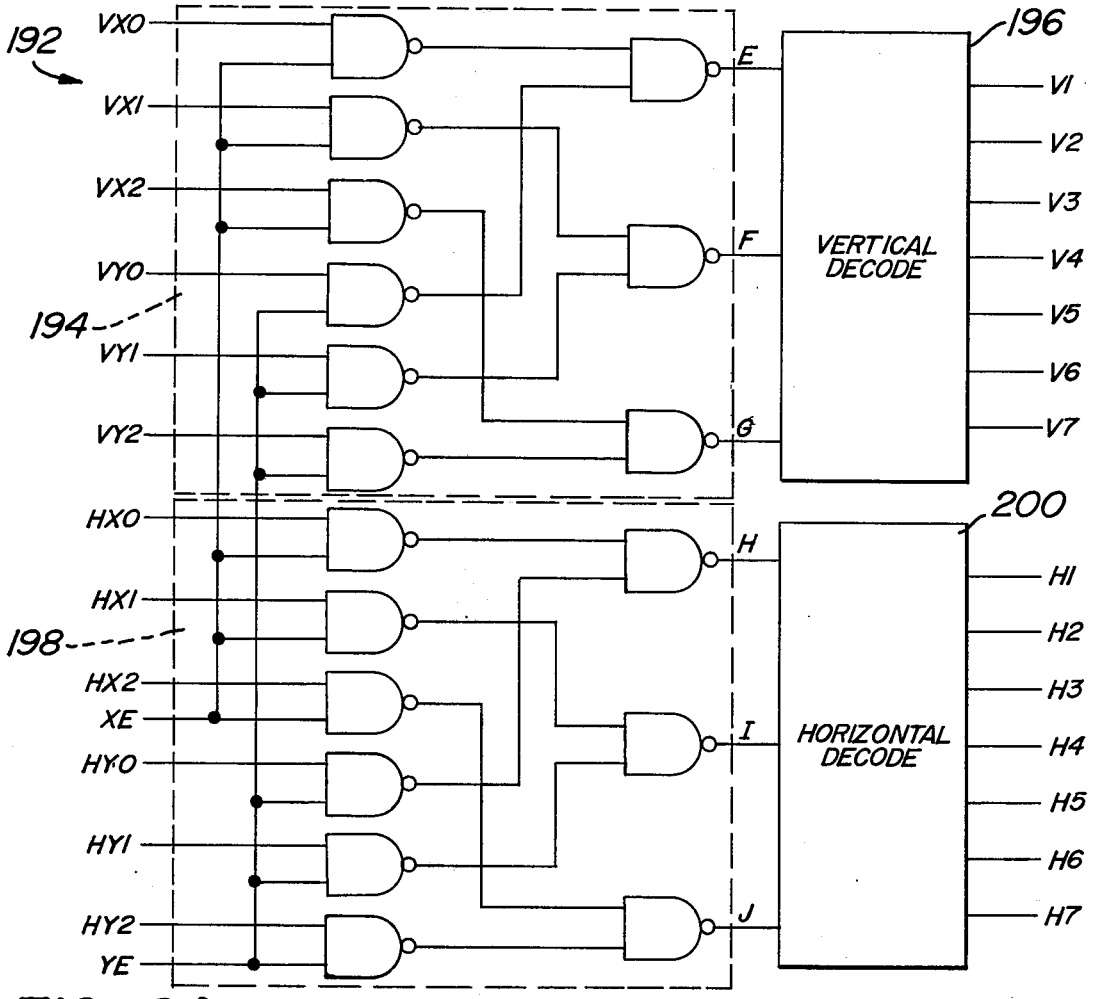
FIG. 6A
FIG. 6B
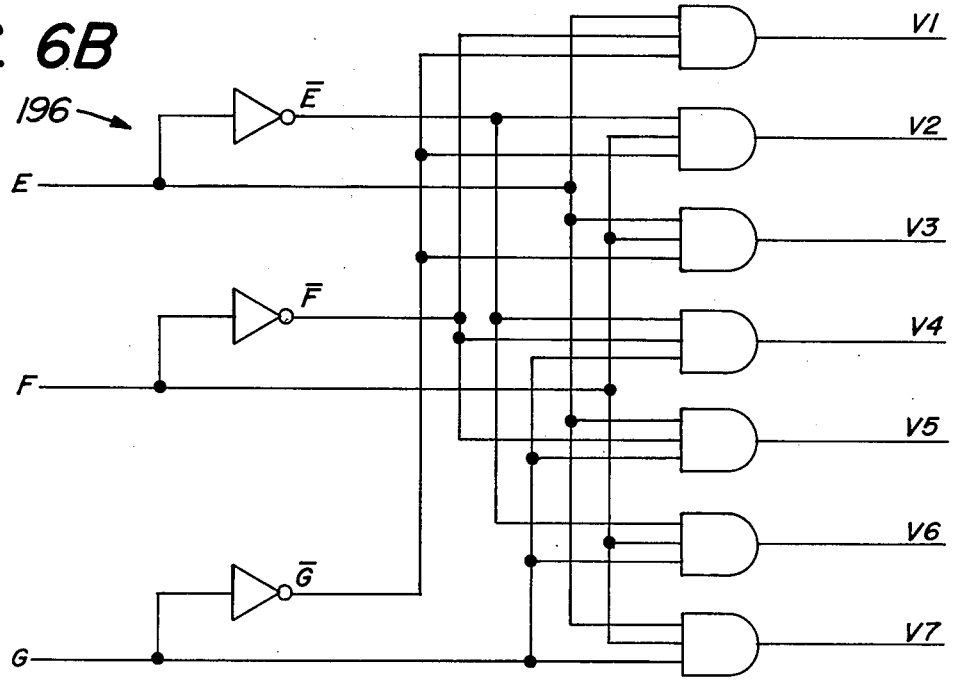

| | | |
|---|---|---|
| SBX7 | SBX14 ··· | SBX49 |
| SBX6 | SBX13 ··· | SBX48 |
| SBX5 | SBX12 ··· | SBX47 |
| SBX4 | SBX11 ··· | SBX46 |
| SBX3 | SBX10 ··· | SBX45 |
| SBX2 | SBX9 ··· | SBX44 |
| SBX1 | SBX8 ··· | SBX43 |
FIG. 8
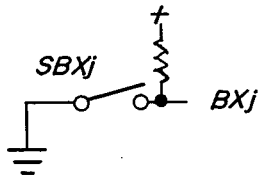
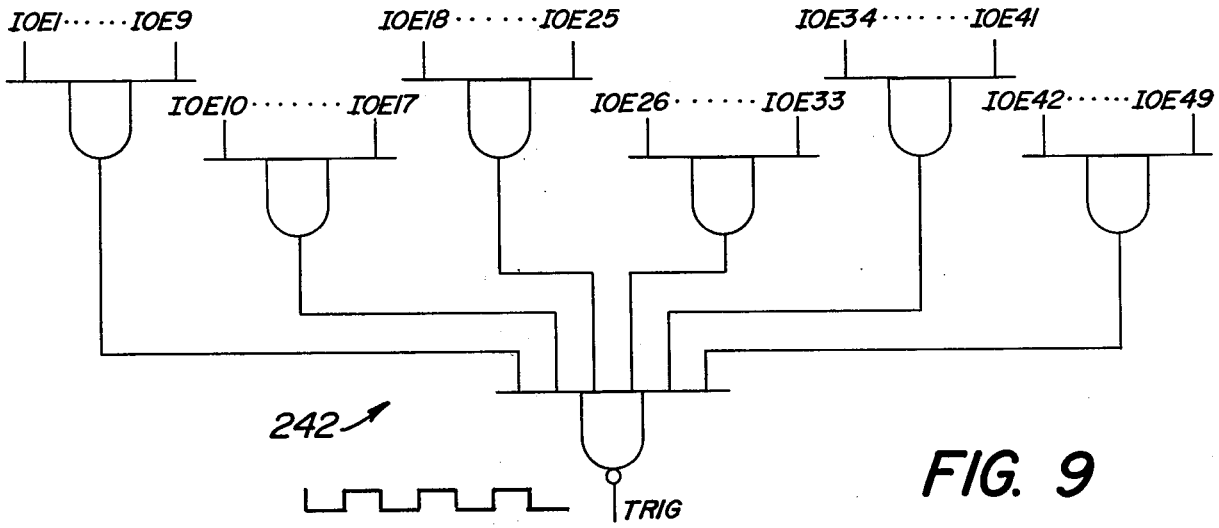
FIG. 9
FIG. 10
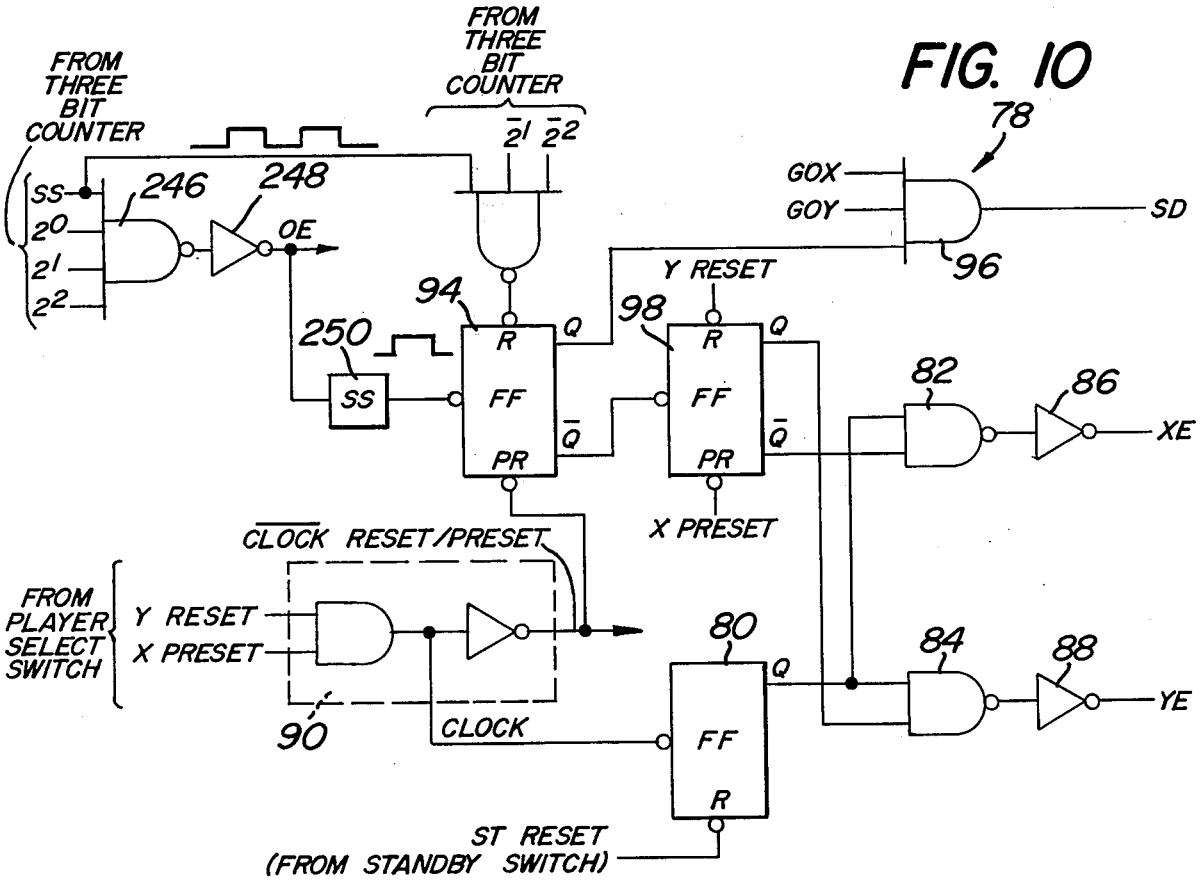

PRE-PROGRAMMABLE OBSTACLE POSITIONING ELECTRONIC GAME

BACKGROUND OF THE INVENTION

The present invention is directed to an electronic game. In particular, the invention is directed to an electronic game in which a player must reach a target position by traversing a maze of obstacles programmed by the player himself or by an opponent. Advance to the target position is entirely controlled by electronic components. The player advances to the target position by progressively occupying intermediate board positions not containing any obstacles. If an obstacle is encountered at a board position, the player is automatically returned to his previous position, and he will need to select a new path to the target position when play reverts to him. Play then shifts to the opponent. There are no player pieces either tangible or imaginary, which must be counted to determine the winner of the game. A game is won by reaching the target position.

Many electronic games are known in the art for playing the well known game of "Battleship". For example, see U.S. Pat. Nos. 3,376,041 and 3,640,536. In such games, the location of the opposing player's pieces are unknown. The goal in these games is to seek out an opposing player's pieces and to keep a log of the number of pieces encountered whereas in the present invention the goal is to avoid the obstacles programmed by an opponent in seeking a single target position of known location.

Various games are also known in the art wherein a player seeks to avoid a series of obstacles of unknown locations in reaching a preselected destination point on a playing board. For example, see U.S. Pat. No. 3,081,088. The patent discloses a manual board game wherein each player is provided with a plurality of colored pieces and a colored transparency for viewing a playing board. Each player arranges his pieces to form a series of hazards or obstacles to the opposing player's moves. The colors of the pieces of one player match the color of the opposing player's transparency. A player attempts to trace a path to a preselected destination point by marking squares on the playing board with a pencil or the like. If a hazard is encountered, the player is advised of the same by his opponent.

Other obstacle games are also disclosed in U.S. Pat. Nos. 3,516,671, 3,404,889 and 3,779,553.

Heretofore, there was no provision for a fully automatic electronic game based upon the placement and avoidance of obstacles in seeking a target or destination position.

An advantage of the present invention is that it is relatively simple to learn and play.

Another advantage of the invention is that it requires virtually no linguistic skills, it requires no verbal communication between players and it can be played without restriction of unfamiliar language.

Another advantage of the invention is that it does not require the performance of any tasks ancillary to the selective placement of obstacles and movement of the players, such as score-keeping and recording of prior moves.

Another advantage of the invention is that it is portable and durable.

Other advantages appear hereinafter.

BRIEF SUMMARY OF THE INVENTION

A game comprising a board provided with plural discrete positions thereon including a predetermined target position; first means for indicating the position of a player on the board; second means for selectively advancing the position of the player on the board; and third means for selectively inhibiting the second means from advancing the position of the player to preselected board positions and for indicating that the second means is so inhibited.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIGS. 6A and 6B comprise a logic diagram of the binary to decimal decoder.

FIG. 8 is a schematic representation of a programmable obstacle board and obstacle switches.

FIG. 9 is a logic diagram of the initiate obstacle encounter gate.

FIG. 10 is a logic diagram of the initialization circuit and player select gate.

DETAILED DESCRIPTION OF THE INVENTION

Figure 1:
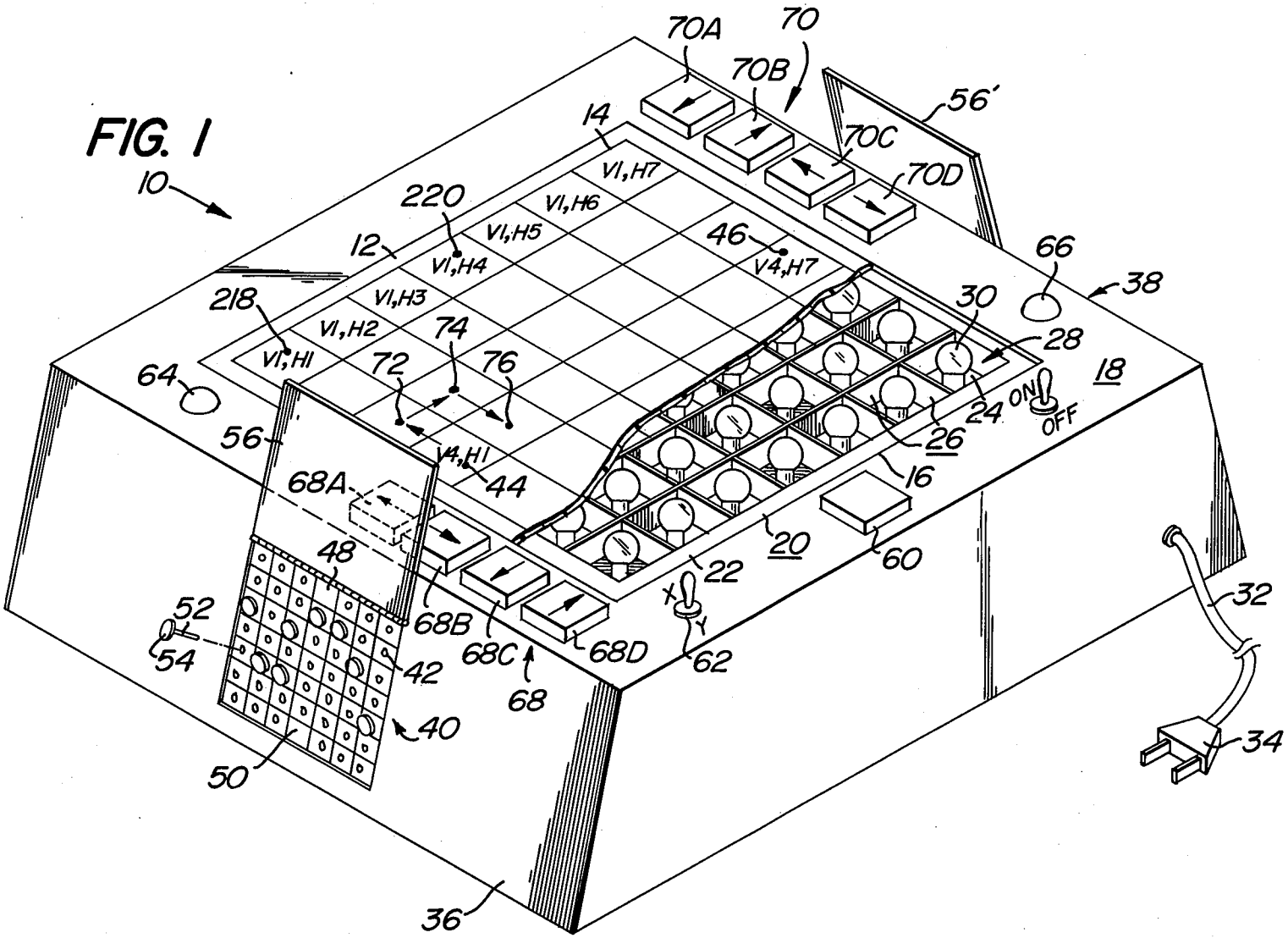
FIG. 1 is a perspective view of the electronic game of the present invention with the playing board partially cut-away.

Referring to the drawings in detail, wherein like numerals indicate like elements, there is shown in FIG. 1 an electronic game 10 constructed in accordance with the principles of the present invention. The game 10 is provided with a playing board 12. The playing board 12 is a substantially square panel of translucent Plexiglas on which is inscribed, painted or otherwise marked a matrix of board positions 14. Preferably, the matrix of board positions is a $7\times7$ matrix. The playing board 12 fits within a substantially square cut-out 16 in a top wall 18.

The cut-out 16 in top wall 18 extends only partially through the top wall and defines an outer boundary for a shoulder 20 which is part of the top wall. The shoulder 20 supports the playing board 12 when the playing board is fitted within the cut-out 16. The inner boundary of the shoulder 20 is defined by a substantially square cut-out 22.

A support panel 24 is disposed below the top wall 18. The support panel 24 is substantially planar and is mounted in any convenient fashion in the interior of the game 10. The support panel 24 is partitioned by reflective walls 26 into a matrix of compartments 28. The matrix of compartments 28 has the same dimensions as the matrix of board positions 14 so that each compartment is associated with a single board position. Light sources or lamps 30 are centrally located in each compartment to illuminate the underside of the playing board 12. Each of the lamps 30 is connected to a voltage bus (not shown) which is connected to a dc power supply hidden within the interior of the electronic game. The power supply may be any suitable dc supply which operates off line voltage. The power supply is connected to a line cord 32 having a plug 34 for insertion in a standard mains outlet.

A logic board (not shown) is hidden within the interior of game 10 below the support panel 24. The logic board contains the electronic logic elements for controlling the lamps 30 as will be described in greater detail hereinafter. The logic board may be a printed circuit board, and the logic elements may be in modular or integrated circuit form.

The front and rear walls 36 and 38 of the game are each provided with a programmable obstacle board 40. The programmable obstacle board 40 is a substantially square portion of the front or rear wall 36 or 38 and is provided with plural apertures 42 which define a matrix of obstacle positions correlated to the matrix of board positions 14. The matrix of obstacle board apertures has the same dimensions as the matrix of playing board positions. As will be described more fully below, the playing board is provided with target positions 44 and 46 which represent the destination points for each player. Accordingly, positions 48 and 50 on the obstacle board are not provided with apertures as these positions correspond to the playing board target positions.

Each of the apertures 42 is sized to receive the prong 52 of a jack or pin 54. Each of the apertures 42 is provided with an electrical connection to ground and an electrical connection to the logic elements of the game as will be described more fully hereinafter. Insertions of the jack 54 in an aperture 42 allows the conductive prong 52 to contact both electrical connections of the aperture thereby supplying a ground signal to an associated logic component. This represents the placement of an obstacle at the associated playing board position.

Each player is provided with a fixed number of jacks 54 for insertion in the player's obstacle board 40. It should be appreciated that the insertion of a jack 54 in an aperture 42 is equivalent to the depression of a switch and that, if desired, the obstacle board could comprise plural switches to form the equivalent electrical function of the jacks and apertures.

Each of the obstacle boards is provided with a cover 56 which is hingedly mounted on the wall immediately above the obstacle board by means of hinge 58. The cover 56 is substantially square and slightly larger than the obstacle board itself so that the cover can be rotated to conceal the obstacle board. When rotated to the raised position shown in FIG. 1, the cover 56 rests flush against the wall 36 to prevent an opponent from viewing the placement of jacks 54 in the apertures 42 of the obstacle board. Thus, the placement of obstacles by a player is concealed from the opponent's view.

A standby switch 60 is mounted on the top wall 18. Preferably, the standby switch is a single pole, single throw momentary pushbutton switch. The standby switch 60 enables illumination of the lamps 30 during play as will be described hereinafter. A player select switch 62 is also mounted on the top wall 18. Preferably, the player select switch 62 is a double pole, double throw momentary toggle switch. The player select switch 62 resets the electronic elements to initiate play and to prepare the logic elements to receive commands from the starting player.

Selection of a player to initiate play is indicated by lamps 64 and 66 mounted on top wall 18. For purposes of explanation herein, it is assumed that two players are participating in the game, the players being designated as player X and player Y. If the player select switch 62 is thrown to select player X to initiate play, lamp 64 will be illuminated. On the other hand, if the player select switch is operated to select player Y to initiate play, lamp 66 will be illuminated. As will be described more fully hereinafter, once the player who initiates play encounters an obstacle at any one of the board positions, the player's lamp 64 or 66 will be extinguished and his opponent's lamp 66 or 64 will be illuminated to indicate that play is to continue but that it is now the opponent's turn. Lamps 64 and 66 are alternately excited in this fashion as play shifts from one player to the other.

Each player begins at his opponent's target position. Thus, player X begins play at player Y's target position 44, and player Y begins play at player X's target position 46. Each player attempts to advance through adjacent board positions to reach his target position. The player may choose any path on the board 12 to reach the target position. The player advances one position at a time along that path. Thus, the player sequentially occupies the board positions along the selected path, one position at a time. Provided that no obstacle has been placed by an opponent at a position to which the player advances, the position will become occupied by the player. This condition will be indicated by illuminating the lamp 30 associated with that position.

A player continues to advance position by position until he encounters an obstacle at one of the board positions. If an obstacle is encountered, the player is returned to the board position which he previously occupied, that is, the position from which he attempted to advance to the position at which his opponent's obstacle is located. The play then shifts to a player's opponent and play is repeated as previously described.

Each player advances from position to position on the board by selective operation of a group of direction switches 68 or 70. Each group of direction switches includes four switches which may be individually operated to advance the player vertically or horizontally from the board position occupied by the player to an adjacent board position to which the player wishes to advance. For example, player X begins at position 44 and may advance in sequence to positions 72, 74 and 76 by sequentially depressing direction switches 68A, 68D and 68B. Accordingly, at the start of play, board position 44 will be illuminated by its associated lamp and, upon depression of switch 68A, that lamp will be extinguished and adjacent board position 72 will be illuminated by its associated lamp. Thereafter, upon depression of switch 68D, the lamp associated with board position 72 will become extinguished and the lamp associated with board position 74 will become illuminated. Upon depression of switch 68B, the lamp associated with board position 74 will become extinguished and the lamp associated with board position 76 will be illuminated. In each case, illumination of a board position indicates that it has become occupied by the player. The player continues to advance through adjacent board positions in this manner until he encounters an opponent's obstacle or until he reaches the target position.

Either player may at any time terminate play upon agreement with his opponent and begin a new game by operating the player select switch 62. Operation of the player select switch results in each player being re-positioned at his opponent's target position.

When a player encounters an obstacle at a board position to which he wishes to advance, the presence of the obstacle is indicated automatically by flashing on and off the lamp associated with the board position at which the obstacle is located. After the lamp has been flashed on and off for a predetermined interval of time, the lamp is extinguished and the lamp associated with the board position from which the player attempted to advance is momentarily illuminated to indicate that the player is being returned to that board position. Thereafter, control passes to the player's opponent. Although play shifts to the player's opponent, the electronic elements store the player's position so that play can be resumed when control reverts to the player.

The manner in which the electronic elements of the game indicate the sequential advance of a player across the board and control the shift of play from player to player is described in detail hereinafter.

Initialization

Figure 2:
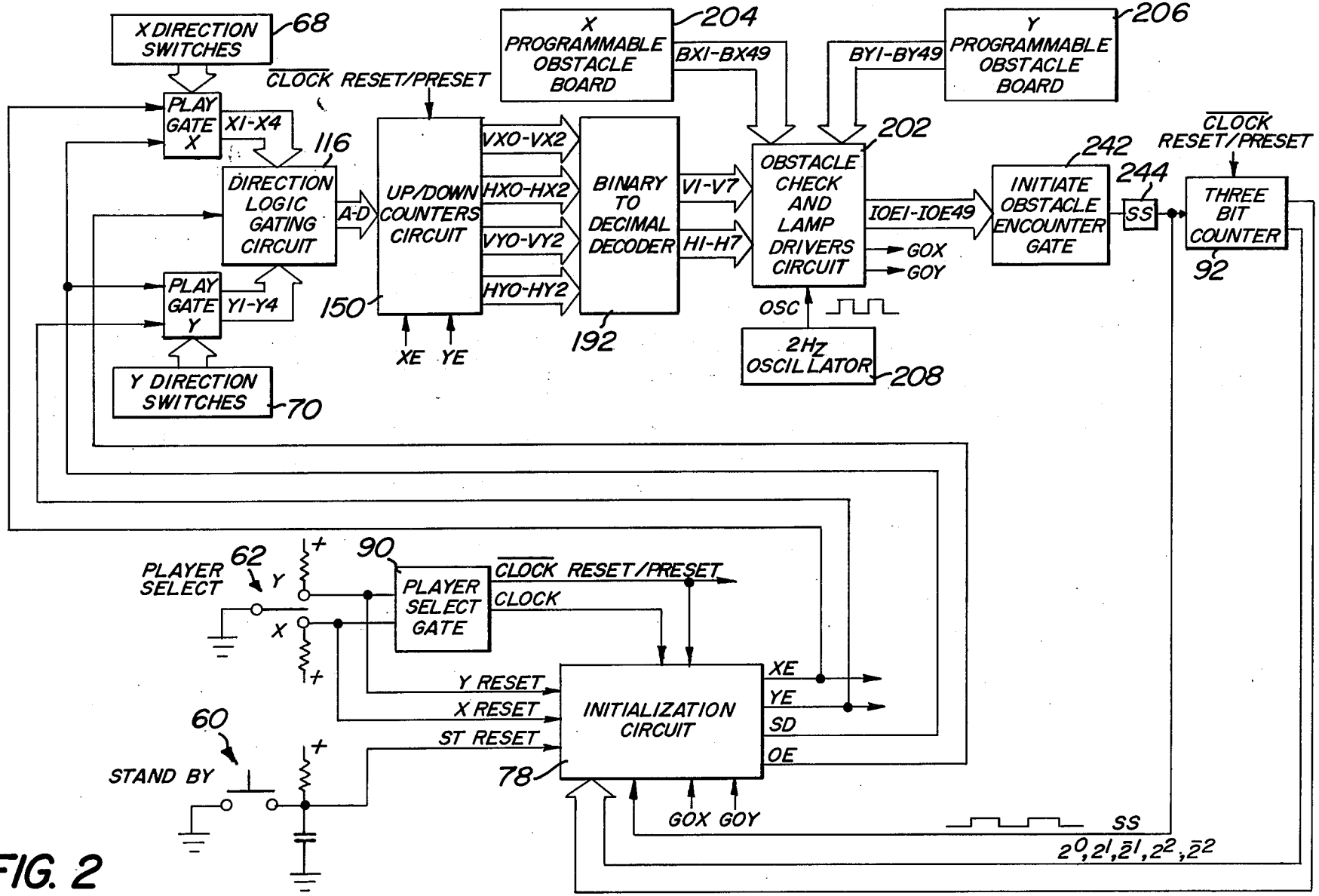
FIG. 2 is a block diagram of the electronic components of the invention.

After power is first applied to the game, a player operates the standby switch 60. See FIG. 2. Operation of the standby switch causes a ST Reset signal to be generated at the input of an initialization circuit 78. The ST Reset signal resets a flip-flop 80 in the initialization circuit. See FIGS. 2 and 10. When flip-flop 80 is reset, its output disables a pair of NAND gates 82 and 84 so that the outputs of inverters 86 and 88, designated XE and YE respectively, remain low. Accordingly, the XE and YE signals disable play gates X and Y from passing direction commands from the X direction switches 68 and the Y direction switches 70 respectively. See FIG. 2. No play can be initiated until the player select switch 62 is toggled momentarily to the X or Y position to indicate selection of player X or player Y to begin play.

When the player select switch is operated, it causes a player select gate 90 to generate a Clock signal and a $\overline{\text{Clock}}$ Reset/Preset signal. In addition, operation of the player select switch 62 causes a Y Reset or a X Preset signal to be generated at the input to the initialization circuit 78 depending on whether player Y or player X is selected.

The Clock signal toggles flip-flop 80 to enable the NAND gates 82 and 84. See FIG. 10. The $\overline{\text{Clock}}$ Reset/Preset signal resets a three bit counter 92, see FIG. 2, and presets a flip-flop 94 in the initialization circuit 78, see FIG. 10. When flip-flop 94 is preset, it enables a NAND gate 96. The function of the NAND gate 96 will be explained more fully hereinafter.

If the player select switch 62 is operated to select player Y, the Y Reset signal resets a flip-flop 98 in the initialization circuit 78. See FIG. 10. When reset, flip-flop 98 causes the YE signal to go high via NAND gate 84 and inverter 88. At the same time, the flip-flop holds the XE signal low via NAND gate 82 and inverter 86. On the other hand, if the player select switch 62 was operated to select player X, the X Preset signal presets flip-flop 98 causing the XE signal to go high while holding the YE signal low. The XE and YE signals respectively enable the play gates X and Y to pass the direction commands of the X direction switches 68 and Y direction switches 70 to the remaining electronic elements. For purposes of explanation hereinafter, it will be assumed that the player select switch 62 is operated to select player X. Accordingly, the XE signal enables play gate X to pass the direction commands supplied by the X direction switches 68. The operation of the remaining electronic elements of the game will be the same, whether the play gate X or the play gate Y is enabled.

Play Gates

Figure 3:
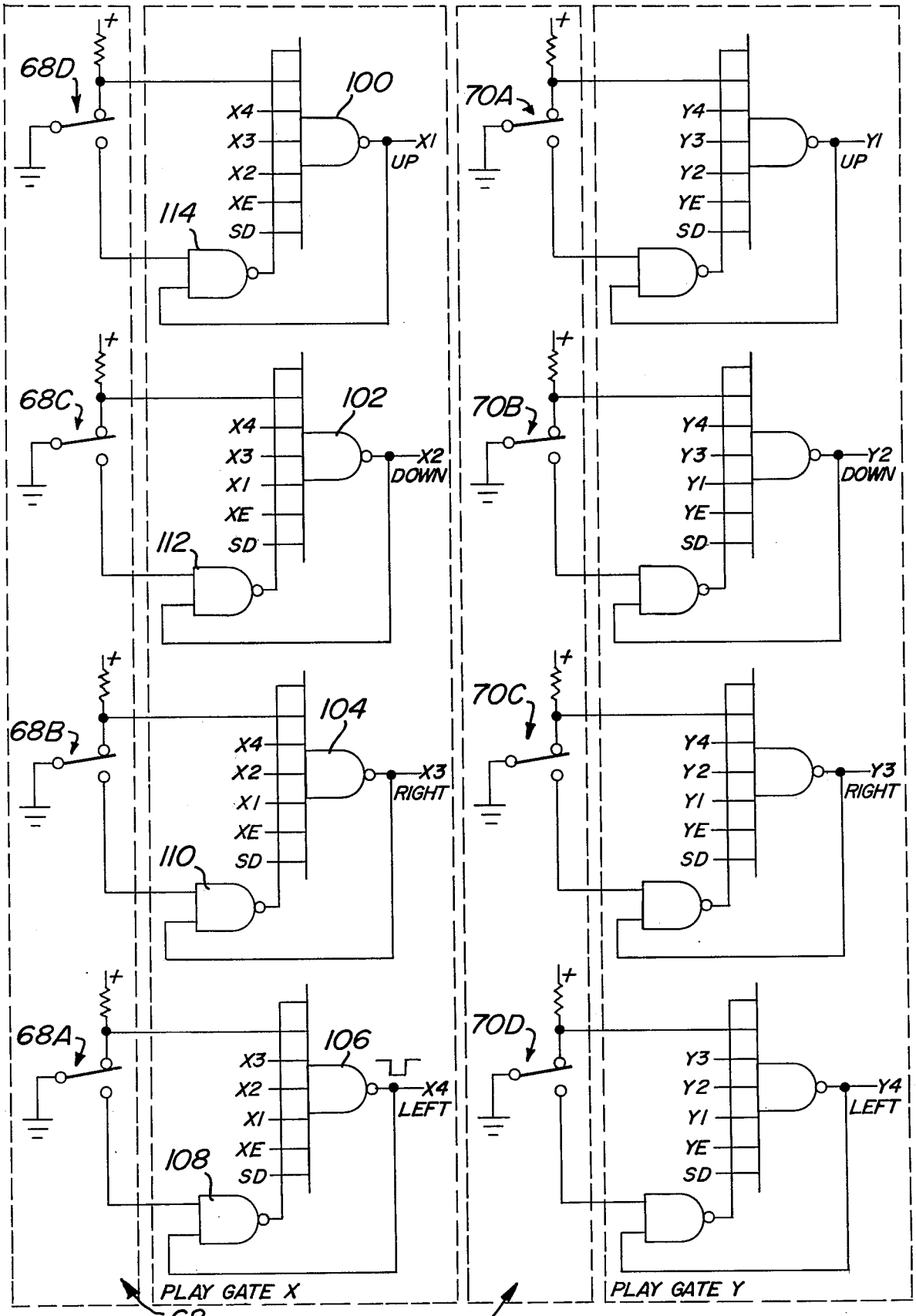
FIG. 3 is a logic diagram of the player direction switches and play gates.

The logic components of the play gates X and Y are shown in FIG. 3. For purposes of explanation, the operation of the logic components of play gate X only will be described, the operation of the components of play gate Y being the same.

Assuming that the player X has been selected to begin play, the XE signal will be high, enabling all four of the NAND gates 100, 102, 104 and 106 in the play gate X. The NAND gates 100–106 are interconnected to prevent more than one of the gates from being operated by its associated direction switch at any given instant of time. Thus, assuming the pattern of play illustrated in FIG. 1, depression of direction switch 68A causes NAND gate 106 to generate a low X4 signal at its output. The X4 signal is fed back to the input of the NAND gate via NAND gate 108 to avoid generating a spurious signal due to switch bounce. NAND gates 110, 112 and 114 perform the same function in connection with their respective gates 104, 102 and 100. When direction switch 68A is released, the X4 signal will return to the high state. Thus, the depression and release of direction switch 68A produces a pulse at the X4 output of NAND gate 106. This pulse indicates to the remaining electronic components that the position of player X on the playing board 12 is to be advanced to board position 72 as will be described more fully below.

Direction Logic Gating

Figure 4:
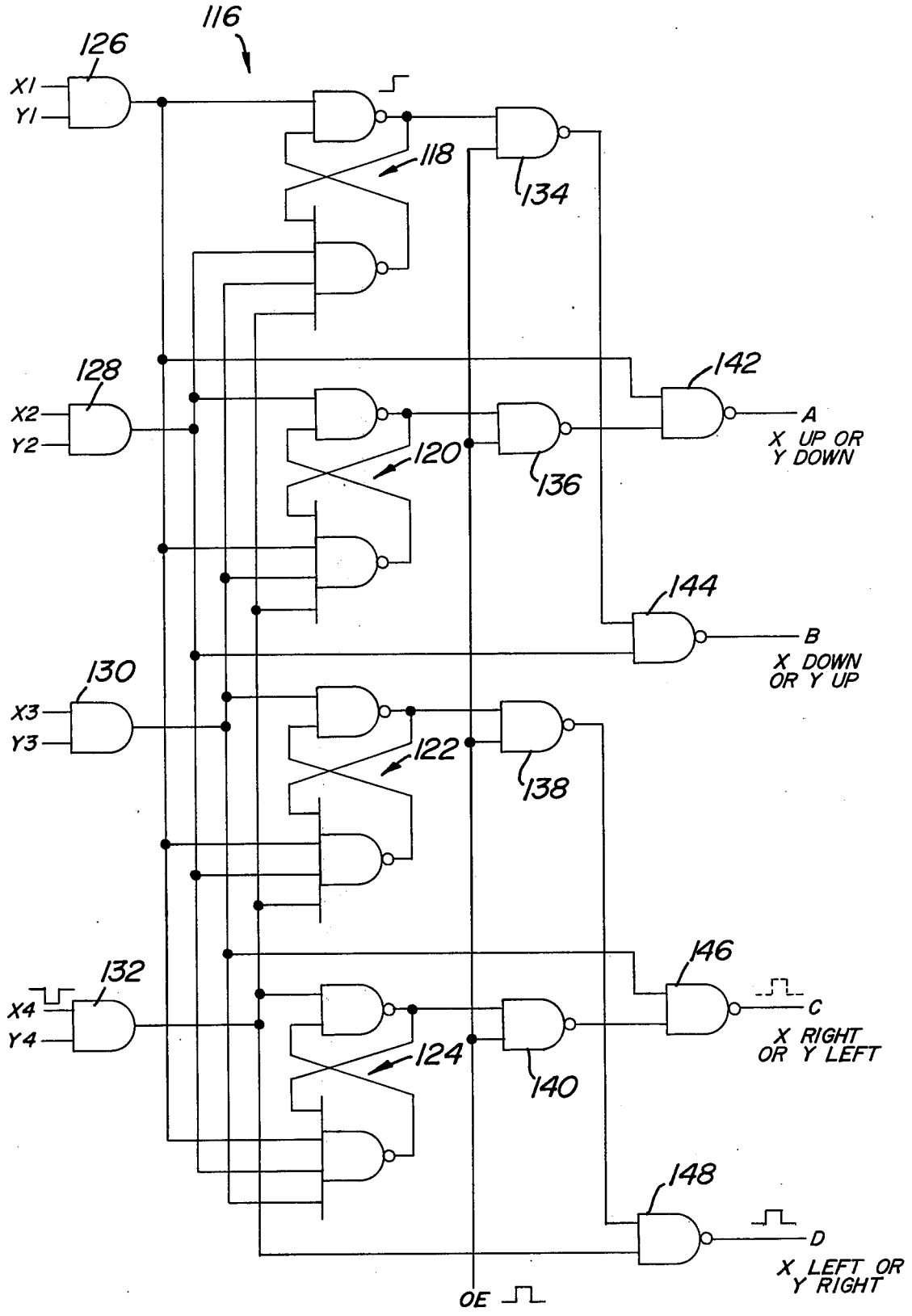
FIG. 4 is a logic diagram of the direction logic gating circuit.

The X1–X4 and Y1–Y4 outputs of play gates X and Y are fed to a direction logic gating circuit 116. See FIG. 2. The logic components of circuit 116 are shown in detail in FIG. 4. The direction logic gating circuit 116 includes a set of S-R flip-flops 118, 120, 122 and 124. Each of the S-R flip-flops is associated with one of a set of input AND gates 126, 128, 130, and 132. Assuming that it is player X's turn, the Y4 signal will be high, thereby enabling AND gate 132. Assuming the direction of play previously described, AND gate 132 will pass the X4 pulse to the S-R flip-flops 118–124.

The S-R flip-flops are interconnected so that when one of them is set, all the others are reset. Accordingly, the X4 pulse is passed through AND gate 132 to set S-R flip-flop 124 and to reset S-R flip-flops 118–122. This causes AND gates 134, 136 and 138 to be disabled while NAND gate 140 is enabled.

If an obstacle is not encountered at board position 72, the O.E. signal input to NAND gates 134–140 will be low, as will be explained more fully below, thereby disabling the NAND gates. Accordingly, each of the output NAND gates 142, 144, 146 and 148 will be enabled. NAND gate 148 will therefore pass the XE pulse, in inverted form, to its D output. The A, B and C outputs of NAND gates 142–146, however, will remain low as the outputs of AND gates 126–130 are high, none of the input signals X1–X3 and Y1–Y3 being low at this time.

If, however, an obstacle is encountered at board position 72, a positive going pulse will subsequently appear on the OE line. See FIG. 4. This pulse will be transmitted through NAND gate 140 and NAND gate 146 to the C output of the direction logic gating circuit. The C output of the circuit indicates that player X, who has moved one position to the left as indicated by signal D, is now automatically moved one position back to the right. In other words, if an obstacle is encountered at board position 72, the C output of the direction logic gating circuit inhibits player X from occupying board position 72 and causes the player to return to the position occupied prior to depression of direction switch 68A.

The precise function of the A–D outputs of direction logic gating circuit 116 is described more fully below in connection with the up/down counters circuit 150. In general, the A–D outputs are paired to permit the advance of a player to a selected board position and to effect the automatic return of the player to his original position if an obstacle is encountered at the selected position. Thus, the A and B outputs represent moves in the vertical up and down directions and the C and D outputs represent moves in the horizontal right and left directions. If a move in the vertical direction as represented by the A output results in an obstacle being encountered, the B output returns the player to his original position and vice versa. If a move in the horizontal direction as represented by the C output results in an obstacle being encountered, the D output returns the player to his original position and vice versa.

Up/Down Counters Circuit

Figure 5:
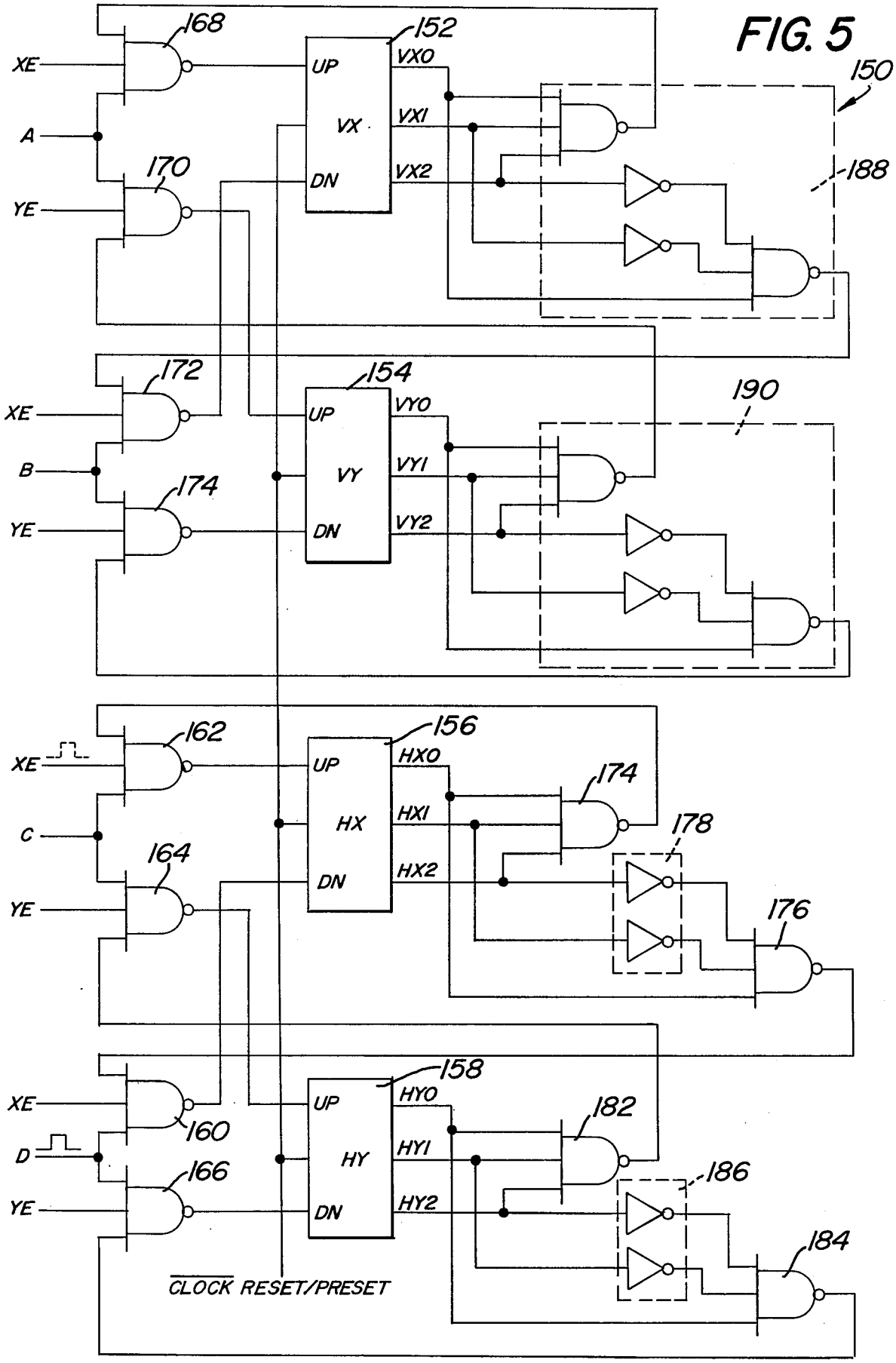
FIG. 5 is a logic diagram of the up/down counters circuit.

The logic components of the up/down counters circuit 150 are shown in FIG. 5. The up/down counters circuit includes four synchronous 4-bit up/down counters 152, 154, 156 and 158. The counters are paired to control play or movement in the vertical and horizontal directions on the playing board 12. Counters 152 and 154 control movement in the vertical directions. Counters 156 and 158 control movement in the horizontal directions. The first or lowest three bit outputs of counters 152 and 154, designated VX0–VX2 and VY0–VY2, represent the vertical coordinates of the board positions of players X and Y respectively. The first three bit outputs of counters 156 and 158, designated HX0–HX2 and HY0–HY2, represent the horizontal coordinates of the board positions of players X and Y respectively. Control of movement in the vertical and horizontal directions is exercised by all counters in the same manner. For purposes of explanation, control of movement in the horizontal direction will be described herein using the example of player X moving from board position 44 to board position 72 in response to a left direction command from direction switch 68A.

When a player is selected to begin play, the $\overline{\text{Clock}}$ Reset/Preset signal generated by player select gate 90 presets counters 152 and 156 to the vertical and horizontal coordinates of target position 44 from which player X begins play. At the same time, the $\overline{\text{Clock}}$ Reset/Preset signal presets counters 154 and 158 to the vertical and horizontal coordinates of target position 46 from which player Y begins play.

When the left direction switch 68A is depressed by player X, a pulse appears at the D output of the direction logic gating circuit 116 as previously described. See FIG. 4. The XE signal enables a NAND gate 160 in the up/down counters circuit to pass the D pulse to the down terminal of up/down counter 156, thereby decrementing the counter. See FIG. 5. Accordingly, when the up/down counter 156 is decremented by the D pulse, the counter outputs indicate the horizontal coordinate of board position 72.

If player Y has placed an obstacle at board position 72, a OE pulse subsequently appears at the C output of the direction logic gating circuit as previously described. See FIG. 4. The XE signal enables a NAND gate 162 to pass the OE pulse to the up terminal of up/down counter 156. Accordingly, the up/down counter is incremented so that its outputs indicate the horizontal coordinate of board position 44 once again. Thus, player X is returned to the board position occupied prior to depression of switch 68A.

Movement in the horizontal direction in response to direction commands supplied by player Y is effected in an identical fashion. Thus, the $\overline{\text{Clock}}$ Reset/Preset signal presets up/down counter 158 to a number which represents the horizontal coordinate of board position 46. A horizontal direction command supplied by player Y will result in a pulse at the C output of the direction logic gating circuit. See FIG. 4. This pulse will be passed by NAND gate 164 which is enabled by the YE signal. See FIG. 5. Accordingly, up/down counter 158 is incremented to a number representing the horizontal coordinate of the position to which player Y has advanced.

If an obstacle is encountered at the position to which player Y has advanced, an OE pulse will subsequently appear at the D output of the direction logic gating circuit. See FIG. 4. The OE pulse will be passed by a NAND gate 166 which is enabled by the YE signal. See FIG. 5. This pulse will cause up/down counter 158 to be decremented. This restores the outputs of the up/down counter to the horizontal coordinate of board position 46. In other words, by decrementing up/down counter 158, player Y is returned to board position 46.

Up/down counters 152 and 154 operate in an identical fashion in connection with NAND gates 168, 170, 172 and 174 to control movement of the players in the vertical direction.

Each of the up/down counters 152–158 is provided with overflow and underflow gates. Operation of the gates in connection with control of vertical movement by counters 152 and 154 and control of horizontal movement by counters 156 and 158 is identical. For purposes of explanation, the operation of the overflow and underflow gates is described in connection with the control of horizontal movement by counters 156 and 158.

Overflow of up/down counter 156 is prevented by overflow gate 174 which is a NAND gate. Underflow of counter 156 is prevented by underflow gate 176 which also is a NAND gate. The first three bit outputs HX0–HX2 of counter 156 are fed to NAND gate 174. Since counter 156 represents the horizontal coordinate of the position of player X, and since the playing board 12 comprises a $7 \times 7$ matrix of board positions, the output of counter 156 must not be permitted to exceed the binary equivalent of the number 7. Accordingly, when the first three bits of counter 156 indicate the binary equivalent of the number 7, NAND gate 174 disables NAND gate 162. As a result, NAND gate 162 is prevented from incrementing counter 156 in response to a pulse on the C line. In effect, then, NAND gate 174 prevents player X from moving off the playing board in the right horizontal direction.

The first three bit outputs of counter 156 are also fed to NAND gate 176, the second and third bits being inverted by a pair of inverters 178. Since the lowest horizontal coordinate of the board position matrix is the number 1, the outputs of counter 156 must not be permitted to fall below the binary equivalent of the number 1. Accordingly, when the outputs of counter 156 indicate the binary equivalent of the number 1, NAND gate 176 disables NAND gate 160. As a result, NAND gate 160 is prevented from decrementing counter 156 in response to a pulse on the D line. In other words, NAND gate 176 prevents player X from moving off the playing board in the left horizontal direction.

In an identical fashion, overflow gate 182, underflow gate 184 and inverter pair 186 prevent player Y from moving off the playing board in the right or left horizontal directions by selectively disabling NAND gates 164 and 166 in connection with up/down counter 158. Similarly, identical overflow-underflow circuits 188 and 190 associated with up/down counters 152 and 154 respectively prevent movement of a player off the playing board in the vertical up and down directions.

Binary to Decimal Decoder

The outputs of the up/down counters 152–158 indicate the vertical and horizontal coordinates of the positions of players X and Y. These outputs are in binary form. These outputs are combined and decoded by binary decimal decoder 192 to control the lamps 30. The logic components of the binary to decimal decoder 192 are shown in FIGS. 6A and 6B.

The vertical coordinates of player X are indicated by the VX0–VX2 signals. The vertical coordinates of the player Y are indicated by the VY0–VY2 signals. These signals are gated through a data selector circuit 194. See FIG. 6A. During player X's turn, the XE signal causes the VX0–VX2 signals to be gated through the data selector circuit to the input lines E, F and G to a vertical decode circuit 196. During the player Y's turn, the YE signal causes the VY0–VY2 signals to be gated through the data selector circuit to the input lines E, F and G.

The vertical decode circuit 196 decodes the vertical coordinate represented by the signals on the E, F and G input lines to decimal form at the V1–V7 outputs. The vertical decode circuit 196 is a 3 input-to-7 output gate circuit as shown in FIG. 6B. The operation of the vertical decode circuit is summarized in Table 1 below.

Table 1

| VX0, (VY0, | VX1, VY1, | VX2 VY2) | V1 | V2 | V3 | V4 | V5 | V6 | V7 |
|---|---|---|---|---|---|---|---|---|---|
| 1 | 0 | 0 | 1 | 0 | 0 | 0 | 0 | 0 | 0 |
| 0 | 1 | 0 | 0 | 1 | 0 | 0 | 0 | 0 | 0 |
| 1 | 1 | 0 | 0 | 0 | 1 | 0 | 0 | 0 | 0 |
| 0 | 0 | 1 | 0 | 0 | 0 | 1 | 0 | 0 | 0 |
| 1 | 0 | 1 | 0 | 0 | 0 | 0 | 1 | 0 | 0 |
| 0 | 1 | 1 | 0 | 0 | 0 | 0 | 0 | 1 | 0 |
| 1 | 1 | 1 | 0 | 0 | 0 | 0 | 0 | 0 | 1 |

The horizontal coordinates of the positions of players X and Y are decoded in identical fashion by data selector circuit 198 and horizontal decode circuit 200. Horizontal decode circuit 200 is identical to vertical decode circuit 196.

Obstacle Check and Lamp Drivers Circuit

The decoded vertical coordinate V1–V7 and the decoded horizontal coordinate H1–H7 are combined in an obstacle check and lamp drivers circuit 202 to control excitation of the lamps 30. See FIG. 2. The lamps 30 indicate the positions occupied by players X and Y during each player's turn.

Figure 7A:
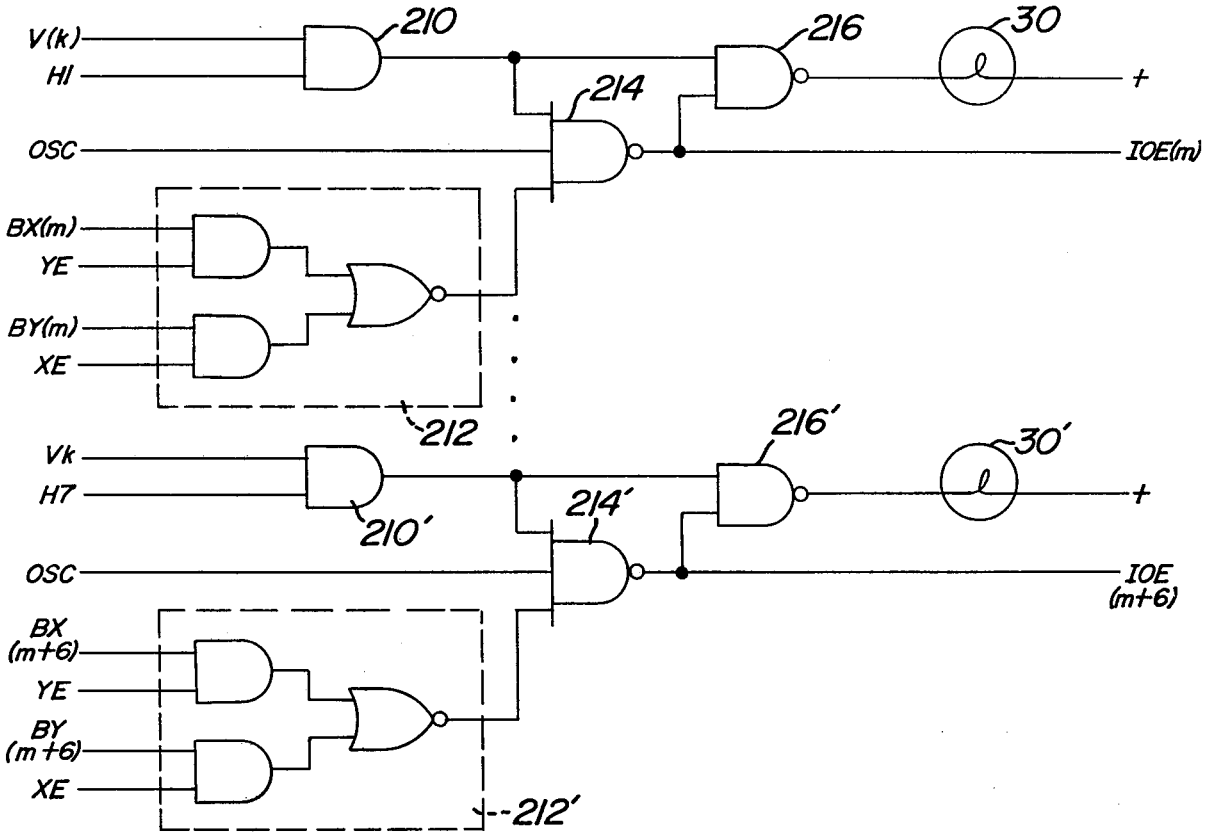
FIGS. 7A and 7B comprise a logic diagram of the obstacle check and lamp drivers circuit.
Figure 7B:
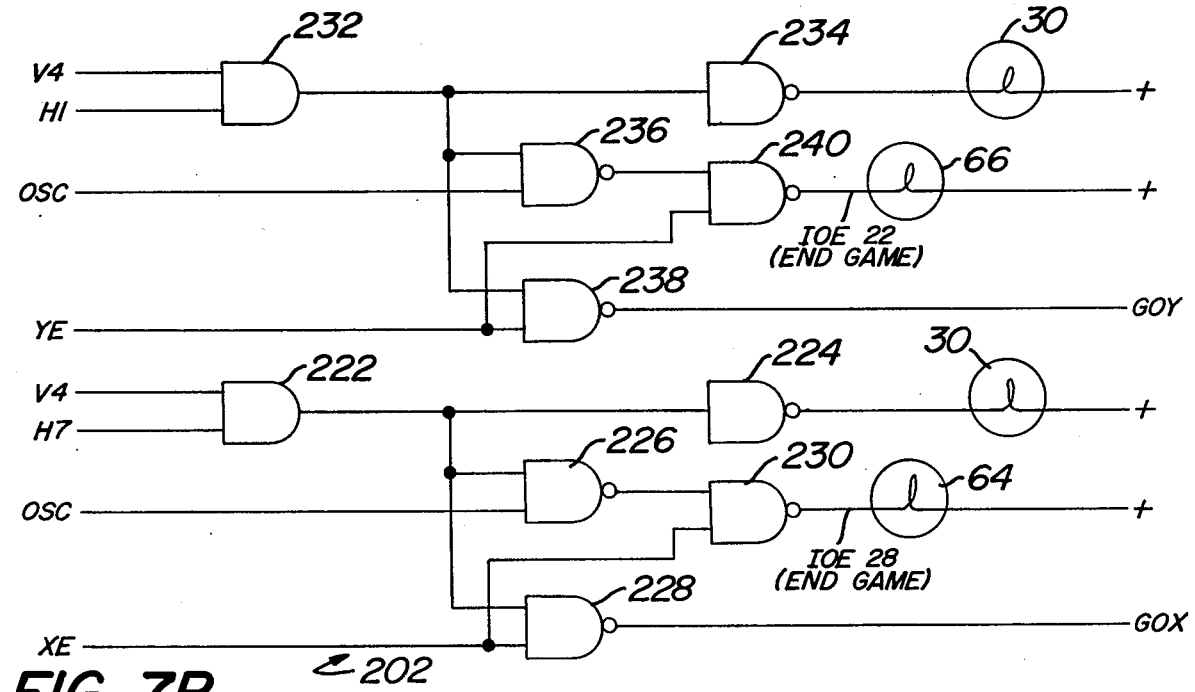

The logic components of the obstacle check and lamp drivers circuit 202 are shown in FIGS. 7A and 7B. The obstacle check and lamp drivers circuit receives the V1–V7 and H1–H7 outputs of binary to decimal decoder 192. In addition, the circuit receives the outputs BX1–BX49 of the player X's programmable obstacle board 204 and the BY1–BY49 outputs of player Y's programmable obstacle board 206. See FIGS. 2 and 7A. The circuit also receives the OSC output of a 2 Hz square wave oscillator 208.

The obstacle check and lamp drivers circuit 202 includes 47 identical gating circuits as shown in abbreviated notation in FIG. 7A. Each such circuit includes an AND gate 210, an AND-OR-INVERT circuit 212, and a pair of NAND gates 214 and 216. As shown in FIG. 7A, the gate circuits are arranged in groups of 7, each group corresponding to a vertical coordinate bit output Vk of the binary to decimal decoder 192. Each gate circuit in a group receives one of the 7 horizontal coordinate bit outputs H1–H7 from the binary to decimal decoder. In addition, each gate circuit in a group receives an output BXm from the X obstacle board 204 and an output BYm from the Y obstacle board 206. The vertical coordinate input Vk and the obstacle board signals BXm and BYm for each group of gate circuits are given in Table 2 below.

Table 2

| Vk, k = | BXm and BYm, m = |
|---|---|
| 1 | 1 |
| 2 | 8 |
| 3 | 15 |
| 4 | 22 |
| 5 | 29 |
| 6 | 36 |
| 7 | 43 |

Thus, the first gate circuit in the group corresponding to the vertical coordinate bit V1 will have inputs V1, H1, BX1 and BY1. The second gate circuit in the group will have inputs V1, H2, BX2 and BY2, and so forth. The seventh gate circuit in the group will have inputs V1, H7, BX7 and BY7. The same arrangement is followed for each group of seven gate circuits associated with each vertical coordinate Vk, for K=2–7 with one exception. Thus, the group corresponding to vertical coordinate V4 consists of five identical gate circuits rather than seven. The two gate circuits which receive the coordinate inputs V4, H1 and V4, H7 are not configured as shown in FIG. 7A. These two gate circuits do not receive outputs from either player's obstacle board since the V4, H1 and Y4, H7 coordinates correspond to the target positions of the players. The structure and operation of these two special gate circuits are described in detail hereinafter.

The gate circuits shown in FIG. 7A correspond to all board positions except the target positions 44 and 46. For purposes of explanation, the operation of the gate circuit having inputs V1, H1, BX1 and BY1 is described herein, the operation of the remaining gate circuits shown in FIG. 7A being identical. The coordinate inputs V1 and H1 correspond to board position 218. See FIG. 1.

Assuming that player X has advanced to board position 218, the V1 and H1 signals will be high. See FIG. 7A. AND gate 210 therefore enables NAND gates 214 and 216. If no obstacle has been placed by player Y at board position 218, the BY1 signal will be high. Since it is player X's turn, the XE signal will also be high. Accordingly, the AND-OR-INVERT circuit 212 will disable NAND gate 214, preventing the NAND gate from passing the OSC signal. As a result, the output of NAND gate 216 will be low, causing lamp 30 associated with board position 218 to be illuminated. This signifies that player X has advanced to board position 218 without encountering an obstacle.

On the other hand, if player Y has placed on obstacle at board position 218, the BY1 signal will be low. Since it is player X's turn, the YE signal will also be low. Accordingly, the output of AND-OR-INVERT circuit 212 will be high enabling NAND gate 214 to pass the OSC signal to its output designated IOE1. The IOE1 signal is an inverted replica of the OSC signal. The OSC signal is a 2 Hz pulse train. NAND gate 216, therefore, pulses lamp 30 associated with board position 218 on and off at the 2 Hz rate. This signifies that player X has encountered an obstacle at board position 218.

A representative schematic of the arrangement of the outputs of an obstacle board is shown in FIG. 8. The schematic corresponds to the arrangement of switches SBXj and outputs BXj on player X's obstacle board, where $j=m, m+1, \ldots m+6$ for each vertical column of obstacle board positions, the arrangement being identical for player Y's obstacle board. Each of the obstacle board positions, except for positions 48 and 50, is adapted to receive a jack 54 as already described. Each of the obstacle board positions is correlated to a position on the playing board 12. The insertion of a jack in an obstacle board position aperture is equivalent to the closing of a grounded switch, shown as switch SBXj in FIG. 8. For example, placement of an obstacle by player X at board position 220, see FIG. 1, is effected by inserting a jack at obstacle board position SBX4. This is equivalent to closure of an imaginary switch SBX4 which grounds the BX4 input to the appropriate gate circuit in the obstacle check and lamp drivers circuit 202. A player can place any number of obstacles provided that at least one path to his opponent's target position is not foreclosed. Preferably, a player is provided with a predetermined number of jacks, or equivalently, a predetermined number of switches SBXm for constructing a maze of obstacles on his obstacle board.

As previously indicated, no obstacles are placed at the obstacle board positions 50 (SBX22) and 48 (SBX28) corresponding to playing board positions 44 and 46. See FIG. 1. Thus, movement to either of these board positions is governed by the two special gate circuits shown in FIG. 7B rather than the gate circuits in FIG. 7A. Coordinate positions V4, H1 correspond to target position 44 and coordinate position V4, H7 correspond to target position 46. If player X advances to target position 46, AND gate 222 causes lamp 30 which is associated with target position 46 to be illuminated by means of NAND gate 224. AND gate 222 also enables NAND gates 226 and 228. NAND gate 226 passes the OSC signal to NAND gate 230. Since it is player X's turn, the XE signal enables NAND gate 230 to pulse on and off lamp 64 which indicates that it is player X's turn. This signifies that player X has reached his target position and that the game is over. At the same time, NAND gate 228 generates a low GOX signal at its output. The purpose of the GOX signal will be explained more fully hereinafter.

Similarly, if player Y advances to target position 44, AND gate 232 enables NAND gate 234 to illuminate lamp 30 associated with target position 44. AND gate 232 also enables NAND gates 236 and 238. NAND gate 236 passes the OSC signal via NAND gate 240 to pulse on and off lamp 66 which indicates that it is player Y's turn. This signifies that player Y has reached his target position and that the game is over. At the same time, NAND gate 238 generates a low GOY signal at its output. The purpose of the GOY signal is explained more fully hereinafter.

Initiate Obstacle Encounter Gate

The IOE1–IOE49 output signals of the gate circuits shown in FIG. 7A are fed to an initiate obstacle encounter gate 242. See FIG. 9. The IOE22 and IOE28 output signals of the gate circuits shown in FIG. 7B, however, are not transmitted to the initiate obstacle encounter gate 242. The IOEj ($j=1$–21, 23–27, 29–49) output signals from the gate circuit shown in FIG. 7A indicate that an obstacle has been encountered at a particular board position. These signals are logically combined by the initiate obstacle encounter gate 242 to provide a triggering signal TRIG to a oneshot 244. See FIGS. 2 and 9. The TRIG signal triggers the oneshot 244. When triggered, the oneshot emits a series of pulses SS. The SS pulses clock the three bit counter 92. See FIG. 2.

The first SS pulse is passed by a NAND gate 246 in the initialization circuit 78 to reset flip-flop 94. See FIG. 10. When reset, flip-flop 94 disables AND gate 96. Accordingly, the SD output of AND gate 96 goes low thereby disabling play gates X and Y. See FIG. 3. Thus, when a player reaches his target position, the play gates X and Y will become disabled to prevent further play.

When the three bit counter 92 counts seven SS pulses, the counter enables a NAND gate 246 in the initialization circuit 78. See FIGS. 2 and 10. NAND gate 246, therefore, will pass the eighth SS pulse via inverter 248 to the OE input to a oneshot 250. This triggers oneshot 250 to toggle flip-flop 94. When toggled, flip-flop 94 enables AND gate 96, restoring the SD signal to its high state. Accordingly, the play gates X and Y are again opened or enabled to permit play to resume. At the same time, the $\overline{Q}$ output of flip-flop 94 toggles flip-flop 98. As a result, the outputs of flip-flop 98 change state. This causes the XE and YE signals to change states via NAND gates 82 and 84 and inverters 86 and 88. When the XE and YE signals change state, control is shifted from one player to the other. The foregoing operations will occur whenever a player encounters an obstacle.

The OE pulse also causes the direction logic gating circuit 116 to return the player to his previous position as already explained. When the player is returned to his original position, the IOEj output of the obstacle check and lamp drivers circuit 202 will be terminated since the XE and YE signals change state at the same time to flip the output of the AND-OR-INVERT circuit 212. See FIG. 7A. Accordingly, no further OE pulses are generated, and the circuit elements are in condition for receiving direction commands from the next player.

Although one embodiment of the invention has been described herein in respect to particular numbers of control elements and a particular configuration of a playing board, it should be noted that these features may be modified without exceeding the spirit or scope of the invention. For example, the matrix of board positions may be of dimensions greater or lesser than the $7\times7$ matrix described herein. In addition, the playing board may comprise a matrix of circular or other geometrically shaped figures. Depending upon the shape of the board position, more than four direction switches may be used to control movement on the board. For example, if hexagonal configured positions are used, six direction switches may be employed to govern movement in the vertical up and down directions, the diagonal up left and right directions, and the diagonal down left and right directions. Moreover, the programmable obstacle boards need not be secured to the walls of the game. Instead, they may be separate portable units which insert into a receptacle in cartridge-fashion. It should also be noted that the game can be played by a single player or by two or more players.

The present invention may be embodied in other specific forms without departing from the spirit or essential attributes thereof and, accordingly, reference should be made to the appended claims, rather than to the foregoing specification as indicating the scope of the invention.

We claim:

1. A game, comprising:

a board provided with plural discrete positions thereon including a predetermined target position;

first means for indicating the position of a player on the board;

second means operable by said player for selectively advancing the position of said player on said board in either of at least two transverse directions; and programmable third means pre-programmable for selectively inhibiting said second means from advancing the position of said player to preselected board positions from any adjacent position and for indicating that said second means is inhibited.

2. The game according to claim 1 including fourth means operatively connected to said second means for indicating that said player has advanced to said predetermined target position.

3. A game, comprising:

a board provided with plural discrete row and column positions thereon including a predetermined target position;

first means for automatically indicating the row and column position of a player on the board;

second means for sequentially advancing the position of said player on said board either through adjacent board rows or through adjacent board columns; and pre-programmable third means for selectively inhibiting said second means from advancing said position of said player to preselected board positions from any positions adjacent to said preselected board positions.

4. The game according to claim 3 including fourth means for indicating that said second means is inhibited.

5. The game according to claim 3 including means operatively connected to said second means for indicating that said player has advanced to said predetermined target position.

6. A game, comprising:

a first board provided with a matrix of discrete player positions including at least one predetermined target position;

first means for automatically indicating that a first player position is occupied by a player;

second means operable by said player for selectively causing said first means to indicate that said first occupied player position has become unoccupied and that a second unoccupied player position adjacent to said first player position along either of at least two transverse directions has become occupied by said player; and pre-programmable third means for selectively inhibiting said second means from causing said first means to indicate that a preselected player position adjacent to said first player position has become occupied and for causing said first means to temporarily indicate that said second means is inhibited.

7. The game according to claim 6 including fourth means operatively connected to said second means for causing said first means to temporarily indicate that said second adjacent player position which has become occupied in said predetermined target position.

8. The game according to claim 7 wherein said fourth means includes means for causing said first means to repetitively indicate over a predetermined time interval that said second adjacent player position which has become occupied is said predetermined target position.

9. The game according to claim 6 wherein said first means includes a plurality of light sources, each of said light sources being associated with one of said player positions.

10. The game according to claim 6 wherein said second means includes plural manually operable direction switches, and means operatively connected to said direction switches for generating a digital signal representative of said second adjacent layer position which has become occupied.

11. A game according to claim 10 wherein said means for generating a digital signal includes plural up/down counters and a binary to decimal decoder associated therewith.

12. The game according to claim 6 wherein said third programmable means includes at least a second board provided with plural obstacle positions correlated to said first board player positions, each of said obstacle positions being provided with an electrical contact, plural manually operable obstacle switches adapted for selective connection with said obstacle position electrical contacts and means operatively connected to said obstacle position electrical contacts for preventing said second means from causing said first means to indicate that said second adjacent player position has become occupied.

13. The game according to claim 12 including means for causing said first means to repetitively indicate over a predetermined time interval that said second means has been prevented from causing said first means to indicate that said second adjacent player position has become occupied.

14. A game according to claim 13 wherein said means for causing said first means to repetitively indicate includes an oscillator.

15. A game for play by at least first and second players, comprising:

a board provided with a matrix of discrete player positions including at least first and second predetermined target positions;

first means for automatically indicating that at least a first player position is occupied by a first player and that at least a second player position is occupied by a second player;

second means operable by said first player for selectively causing said first means to indicate that said first occupied player position has become unoccupied and that an unoccupied player position adjacent to said first player position along either of at least two transverse directions has become occupied by said first player;

third means operable by said second player for selectively causing said first means to indicate that said second occupied player position has become unoccupied and that an unoccupied player position adjacent to said second player position along either of at least two transverse directions has become occupied by said second player;

pre-programmable fourth means operable by said second player for selectively inhibiting said second means from causing said first means to indicate that a preselected player position adjacent to said first player position has become occupied by said first player and for causing said first means to indicate that said second means is inhibited; and pre-programmable fifth means operable by said first player for selectively inhibiting said second means from causing said first means to indicate that a preselected player position adjacent to said second player position has become occupied by said second player and for causing said first means to indicate that said second means is inhibited.

16. A game according to claim 15 including sixth means operatively connected to said second means for causing said first means to temporarily indicate that said player position adjacent to said first occupied player position is said first predetermined target position, and seventh means operatively connected to said second means for causing said first means to temporarily indicate that said player position adjacent to said second player position is said second predetermined target position.

* * * * *